United States Patent [19]

Mueller

[11] Patent Number: 4,892,492

[45] Date of Patent: Jan. 9, 1990

[54] DEVICE WITH OPENINGS FOR RECEIVING PINS OF ELECTRICAL COMPONENTS

[75] Inventor: Harry B. Mueller, Hollywood Hills, Fla.

[73] Assignee: Modular Computer Systems, Inc., Fort Lauderdale, Fla.

[21] Appl. No.: 207,879

[22] Filed: Jun. 17, 1988

[51] Int. Cl.[4] ..... H01R 4/48

[52] U.S. Cl. ..... 439/828; 439/843; 439/852; 439/78

[58] Field of Search ..... 439/78, 81, 816, 828, 439/832, 833, 843, 851, 852, 856, 862, 629–637

[56] References Cited

U.S. PATENT DOCUMENTS 3,407,379 10/1968 Nakazawa et al. ..... 439/639
3,980,377 9/1976 Oxley ..... 439/637
4,002,400 1/1977 Evans ..... 439/851
4,647,140 3/1987 Crawford ..... 439/629

FOREIGN PATENT DOCUMENTS 0000163 1/1979 European Pat. Off. ..... 439/851

*Primary Examiner*—David Pirlot
*Attorney, Agent, or Firm*—Spencer & Frank

[57] ABSTRACT

In a device with openings for receiving pins of electrical components therein an including spring elements which are bowed in toward the center of the opening at the bottom thereof, and is then bowed out in the middle of the opening and drawn back towards the center of the opening at the top to form a funnel for receiving one of the pins.

5 Claims, 2 Drawing Sheets

DEVICE WITH OPENINGS FOR RECEIVING PINS OF ELECTRICAL COMPONENTS

BACKGROUND OF THE INVENTION

Electronic components used in computer technology usually have multiple contacts (pins) for interconnection. To connect the contacts (pins), a certain connecting technology is necessary.

SUMMARY OF THE INVENTION

It is the object of the invention to provide a device to connect and hold the pins of electronic components, as for instance integrated circuits, in a simple and reliable manner. According to the invention there is provided a device with openings for receiving pins of electrical components, wherein in the openings spring elements are provided which are oriented axially and are bowed in axially toward the center of the opening, then bowed out axially in the middle of the opening and drawn back axially towards the center of the opening at a top of the device to form a funnel for receiving the pin.

DESCRIPTION OF THE PREFERRED EMBODIMENTS

Figure 1:
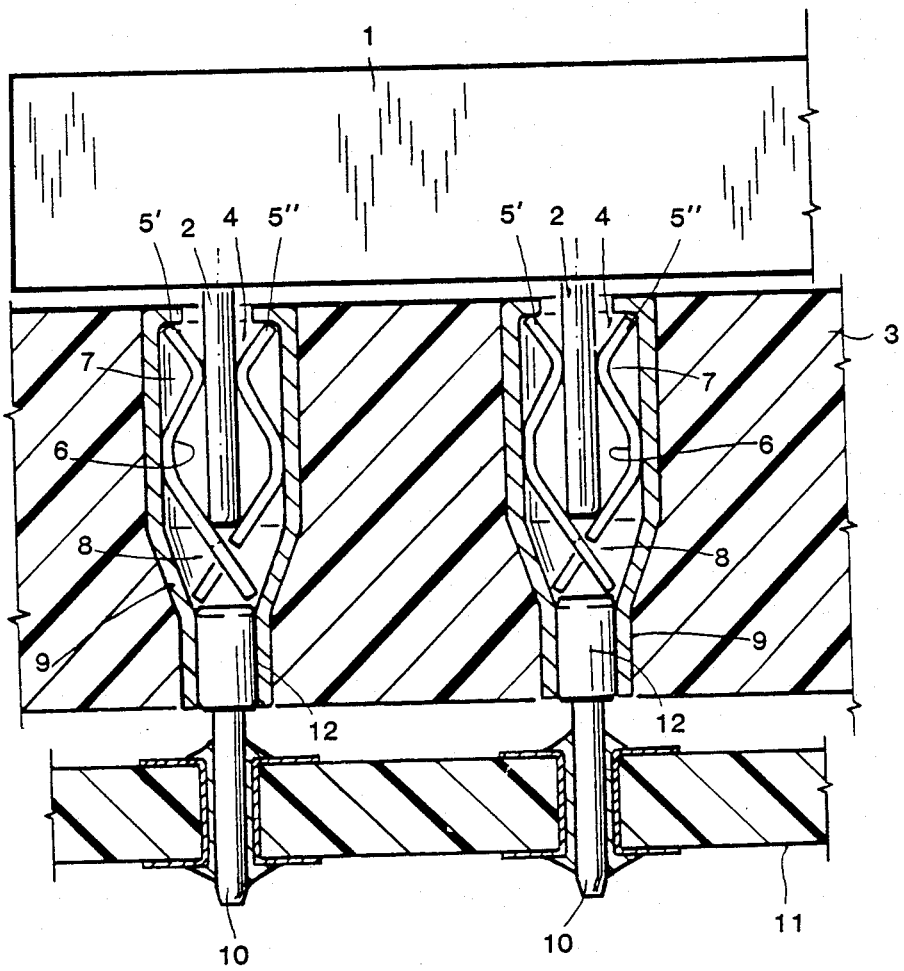
FIG. 1 is a side sectional view of a device according to the invention.

FIG. 1 shows an electronic component 1 with pins 2. For better illustration only two pins are shown. Actually the electronic component has a multiplicity of pins. The electronic component 1, for example, can be an integrated circuit. The electrical contact of the pins 2 of the integrated circuit shown in FIG. 1 can be made by a board 3. The board 3 is, for example, a printed wiring board (PW board). The PW board 3 has a thickness of approximately 3 to 4 mm. In accordance with FIG. 1, the PW board 3 has openings 4 which will receive and hold the pins 2 and connect to the pins 2.

A plurality of spring elements (5', 5") are responsible for maintaining contact with the pins 2. Two of these elements (5', 5") are situated in the opening (4) and are shown in FIG. 1. More than two of the spring elements (5', 5") can be used in this configuration. The spring elements (5', 5") could be constructed from metal strips 2 to 3 mm wide and 0.5 to 1 mm thick. Copper alloy could be just one of the many types of material used.

As shown in FIG. 1, the spring elements are "S" shaped. According to FIG. 1, the spring elements (5', 5") extend axially and are bowed radially outwardly in a center portion (6). Because of the elasticity of the material, the spring elements (5', 5") are kept in position by being forced inwardly by the pin 2 against the inside wall of the opening 4. At an upper end (7) of the opening 4, the spring elements (5', 5") are directed toward each other but in the area of the top of the opening 4, the spring elements (5', 5") are directed away from each other to accommodate pin entry.

Figure 2:
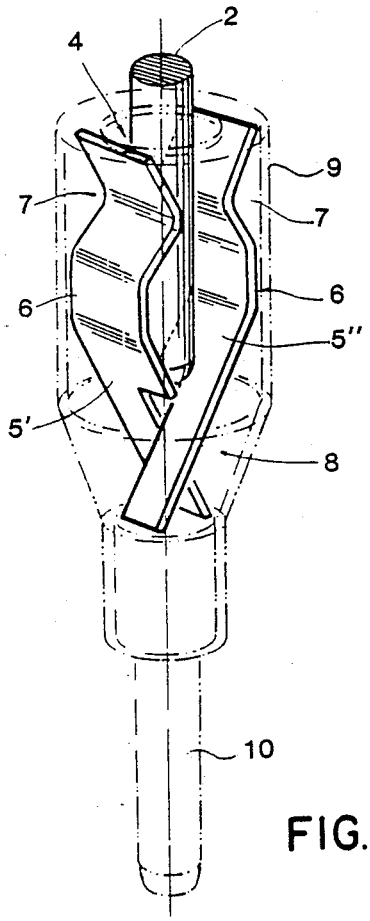
FIG. 2 is a perspective view of crossing spring elements usable with the invention.
Figure 3:
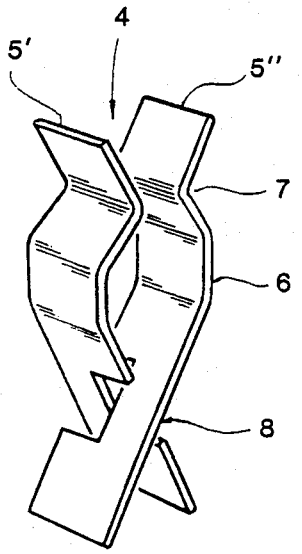
FIG. 3 shows another embodiment of the crossing spring elements.

When the pins 2 are inserted in the funnel shaped opening 4, the spring elements (5', 5") are separated by the inserted pin 2. The inserted pin 2 may be inserted into the opening 4 down to the area 8 where the two spring elements (5', 5") are located at the same level. A converging of the two spring elements (5', 5") is possible only if one (5') of the two spring elements (5', 5") has a slot for entry of a tapered end of the other element (5") (FIG. 2), or as shown in FIG. 3, where both spring elements (5', 5") have a tapered cross section which will allow convergence thereof.

The two spring elements 5' and 5" shown in FIG. 1 are configured in the opening (4) so that the inserted pin 2 is pressing against the crossover location 8 of the spring elements (5', 5"). The pressure generated by inserting the pin in the crossover area 8 of the two spring elements (5', 5") is transferred to the upper ends 7 of the spring elements (5', 5") and will generate pressure against the pin 2. The pressure generated by the spring elements (5', 5"), will keep the pin 2 at a fixed location in the opening.

An inner wall 9 bounding the opening 4 consists of a layer of metal. At the lower end of the opening 4, metal pins (10) are present which will conduce electrical current via the inner wall 9 composed of a metal shell or layer and the spring elements (5', 5") from the pin 2. The pins (10) can be inserted according to FIG. 1 in to the holes of a printed circuit board (11). In order to further electrical contact between the printed circuit board 11 and the component 1 the openings (4) in the region below the spring elements (5', 5") are filled with a metal member (12).

The length of the spring elements (5', 5") will be matched to the length of the inserted pins 2. In the instance where the spring elements (5', 5") are crossed, the crossing point will move downwards as the pin is inserted.

The board 3 can be produced in the following manner. The basic material of the board is an electrically isolating material. The body of the board 3 is provided with through holes. These holes are lined with metal casing to form the inner walls 9 which will conduct signals to or from the spring elements (5', 5"). In addition, the isolating material also contains metal paths by which signals are conducted from one part of the board to another.

What is claimed is:

1. A device for receiving pins of electrical components in electrical connection, comprising:

a substrate having an opening therein which extends axially into said substrate and which is bounded by an electrically conductive sidewall, said opening having a mouth, a central axis, an upper portion and a lower portion; said sidewall having a lower concave portion and a lip projecting generally radially inwardly adjacent said mouth of said opening;

a pair of spring elements disposed within said opening which are in facing relationship to each other, each of said spring elements having an upper end portion, a center portion, and a terminal portion;

said terminal portion of each said spring being disposed in said lower portion of said opening in engagement with said concave portion of said sidewall so as to retain said terminal portion of said spring in a fixed axial position, each said spring extending generally axially from a first side of said opening across said central axis to the opposite side of said opening, both of said spring elements crossing said central axis at substantially common location; and each said spring having a substantially sheet-like body, said terminal portion of each said spring contacting said sidewall in the vicinity of said lower portion of said opening, said upper end portion of each said spring engaging said lip of said sidewall in the vicinity of said upper portion of said opening so as to retain said spring within said opening, and said center portion of each said spring having a first portion which extends generally radially toward said central axis and a second portion which extends generally radially from said first portion toward said sidewall.

2. A device according to claim 1, wherein said spring elements are fixed and held within said opening due to spring force which is generated by deformation of said spring elements within said opening due to insertion of a pin generally axially into said opening, wherein said spring elements are resiliently deformed from an initial position to a final position wherein said second portion of each said spring is in contacting spring-biased engagement with said sidewall and wherein said first portion of each said spring is in contacting spring-biased engagement with the pin.

3. A device according to claim 2, wherein said upper end portions of each of said spring elements in said initial position cooperate to form a gap for receiving the pin such that the pin is in contact with both of said spring elements at said upper end portion, and the spring pressure generated at said terminal portions is transferred to said upper end portion of said springs to exert increased pressure on the pin.

4. A device as defined in claim 3, wherein one of said spring elements has a slot in its said terminal portion and said terminal portion of the other of said spring elements has a relatively reduced width and is disposed in said slot.

5. A device according to claim 3, wherein said terminal portion of both said spring elements have a relatively reduced width.

* * * * *